US005560609A

United States Patent [19]

Grant

[11] Patent Number: 5,560,609

[45] Date of Patent: Oct. 1, 1996

[54] SIMULATED TRACK COMPETITION GAME

[76] Inventor: Frederick Grant, 96-08 57th Ave., Apt 3G, Queens, N.Y. 11368

[21] Appl. No.: 592,970

[22] Filed: Jan. 29, 1996

[51] Int. Cl.[6] ..... A63F 3/00

[52] U.S. Cl. ..... 273/246

[58] Field of Search ..... 273/242, 243, 273/246, 244, 248, 249

[56] References Cited

U.S. PATENT DOCUMENTS

| | | | |
|---|---|---|---|
| 3,463,496 | 8/1969 | Weinstein et al. | 273/246 |
| 4,799,685 | 1/1989 | Hoffman | 273/246 |
| 5,092,605 | 3/1992 | Hoffman | 273/246 |
| 5,114,151 | 5/1992 | Bergerstock | 273/246 |
| 5,322,293 | 6/1994 | Goyette | 273/246 |

*Primary Examiner*—William E. Stoll

[57] ABSTRACT

A simulated track competition game for entertaining and educating players. The inventive device includes a game board having an oval track printed thereon. A method of play of the game includes moving player markers around the track in accordance with chance devices such as dice and cards to simulate a track competition.

9 Claims, 3 Drawing Sheets

SIMULATED TRACK COMPETITION GAME

BACKGROUND OF THE INVENTION

1. Field of the Invention

The present invention relates to board game structures and more particularly pertains to a simulated track competition game for entertaining and educating players.

2. Description of the Prior Art

The use of board game structures is known in the prior art. More specifically, board game structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art board game structures include U.S. Pat. No. 4,583,741; U.S. Pat. No. 5,114,151; U.S. Pat. No. 5,050,888; U.S. Pat. No. 4,832,347; U.S. Pat. No. 5,064,200; and U.S. Pat. No. 4,042,245.

While these devices fulfill their respective, particular objectives and requirements, the aforementioned patents do not disclose a simulated track competition game for entertaining and educating players which includes a game board having an oval track printed thereon, with a method of play of the game including moving player markers around the track in accordance with chance devices such as dice and cards to simulate a track competition.

In these respects, the simulated track competition game according to the present invention substantially departs from the conventional concepts and designs of the prior art, and in so doing provides an apparatus primarily developed for the purpose of entertaining and educating players.

SUMMARY OF THE INVENTION

In view of the foregoing disadvantages inherent in the known types of board game structures now present in the prior art, the present invention provides a new simulated track competition game construction wherein the same can be utilized for entertaining and educating players. As such, the general purpose of the present invention, which will be described subsequently in greater detail, is to provide a new simulated track competition game apparatus and method which has many of the advantages of the board game structures mentioned heretofore and many novel features that result in a simulated track competition game which is not anticipated, rendered obvious, suggested, or even implied by any of the prior art board game structures, either alone or in any combination thereof.

To attain this, the present invention generally comprises a simulated track competition game for entertaining and educating players. The inventive device includes a game board having an oval track printed thereon. A method of play of the game includes moving player markers around the track in accordance with chance devices such as dice and cards to simulate a track competition.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new simulated track competition game apparatus and method which has many of the advantages of the board game structures mentioned heretofore and many novel features that result in a simulated track competition game which is not anticipated, rendered obvious, suggested, or even implied by any of the prior art board game structures, either alone or in any combination thereof.

It is another object of the present invention to provide a new simulated track competition game which may be easily and efficiently manufactured and marketed.

It is a further object of the present invention to provide a new simulated track competition game which is of a durable and reliable construction.

An even further object of the present invention is to provide a new simulated track competition game which is susceptible of a low cost of manufacture with regard to both materials and labor, and which accordingly is then susceptible of low prices of sale to the consuming public, thereby making such simulated track competition games economically available to the buying public.

Still yet another object of the present invention is to provide a new simulated track competition game which provides in the apparatuses and methods of the prior art some of the advantages thereof, while simultaneously overcoming some of the disadvantages normally associated therewith.

Still another object of the present invention is to provide a new simulated track competition game for entertaining and educating players.

Yet another object of the present invention is to provide a new simulated track competition game which includes a game board having an oval track printed thereon, with a method of play of the game including moving player markers around the track in accordance with chance devices such as dice and cards to simulate a track competition.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
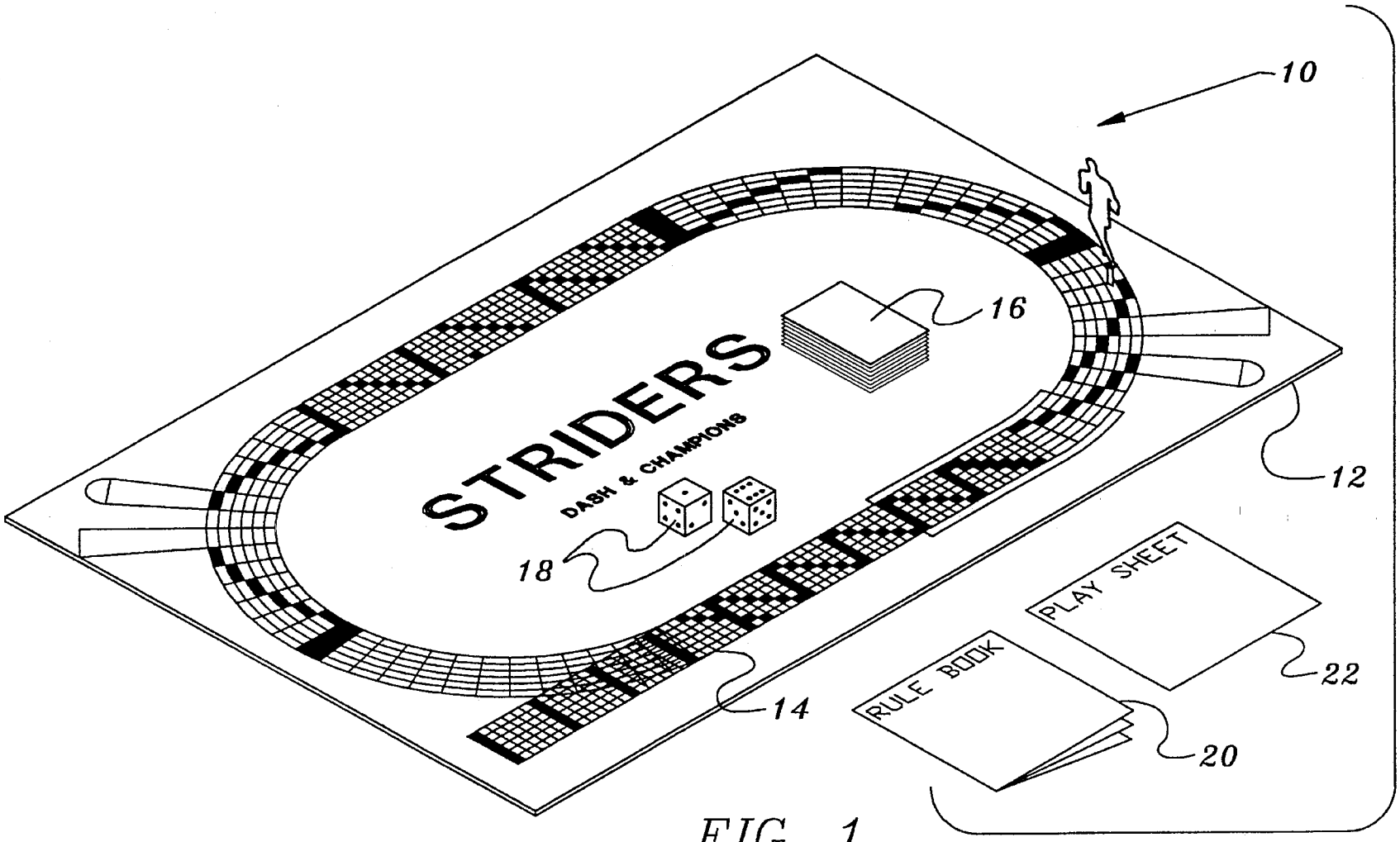
FIG. 1 is a perspective illustration of the preferred embodiment of the simulated track competition game constructed in accordance with the principles of the present invention.

With reference now to the drawings, and in particular to FIGS. 1–7 thereof, a new simulated track competition game embodying the principles and concepts of the present invention and generally designated by the reference numeral 10 will be described.

APPARATUS OF THE GAME

More specifically, it will be noted that the simulated track competition game 10 comprises a game board 12 having an oval track 14 printed thereon. A pair of dice 16 and a plurality of cards 18 are provided as chance devices for play of the game 10. A rule book 20 can be included for quick reference to the rules of the game 10 as will be set forth hereinafter in more detail. A play sheet 22 allows for recording aspects of the game such as score and the like.

Figure 2:
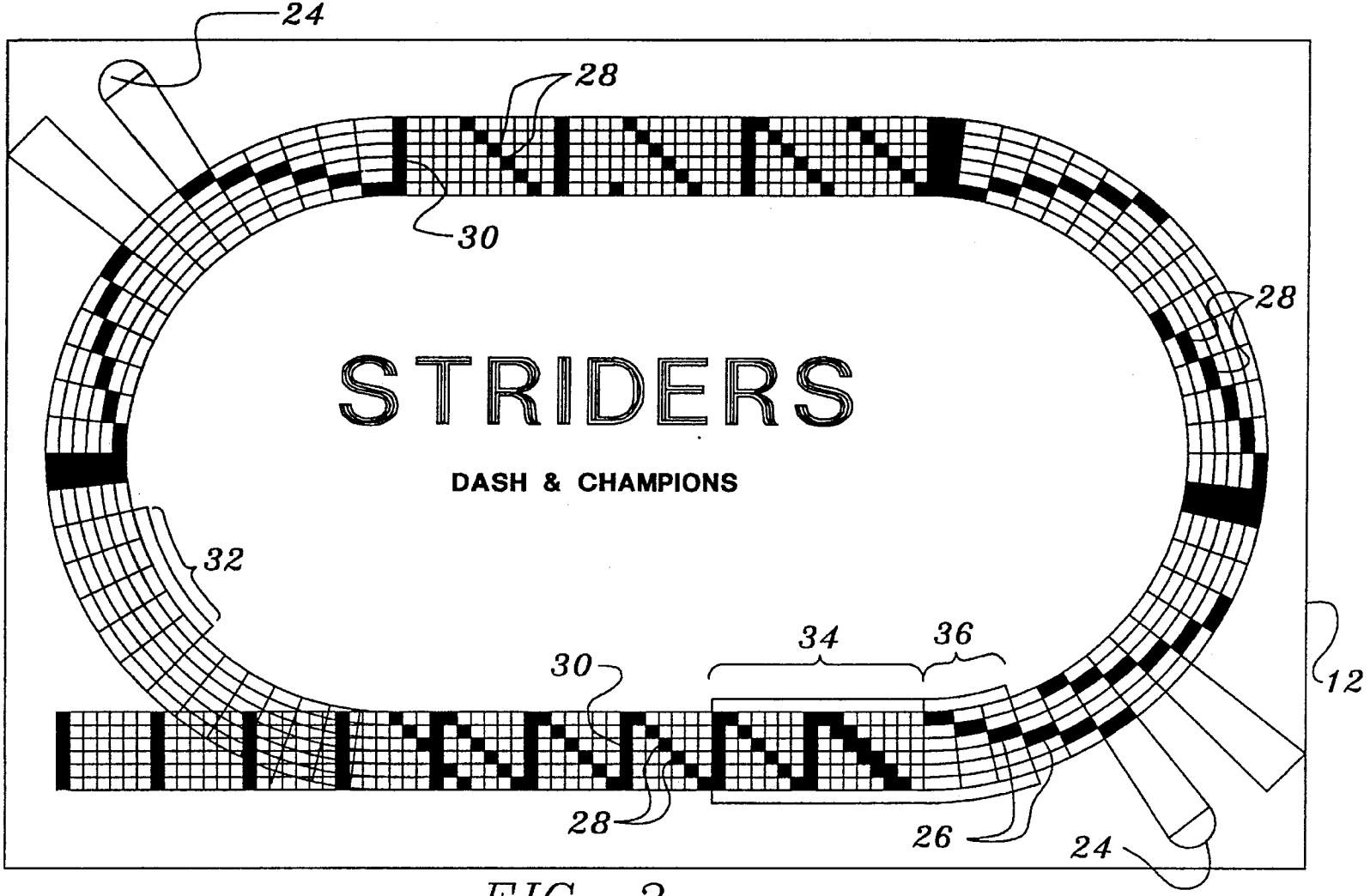
FIG. 2 is a top plan view of the present invention.
Figure 3:
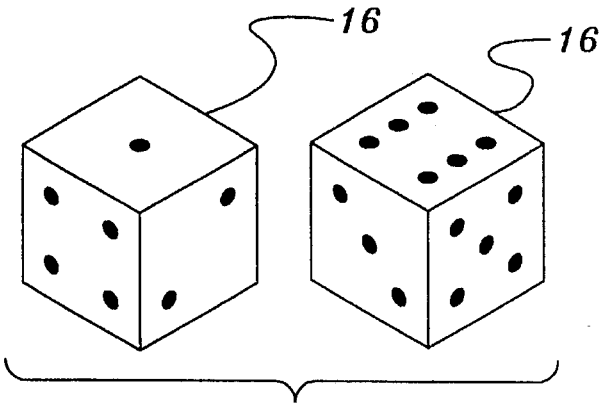
FIG. 3 is a perspective illustration of dice of the invention.
Figure 4:
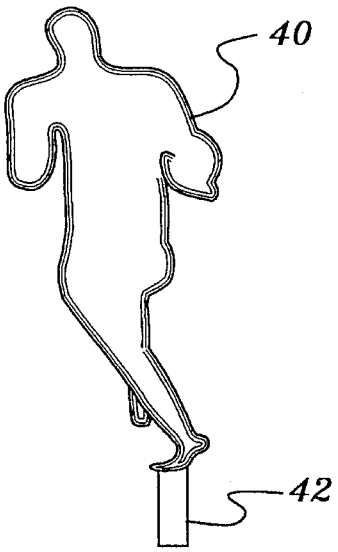
FIG. 4 is an elevational view of a player marker of the invention.

As shown in FIG. 2, the track 14 of the game board 12 includes indicia thereon defining particular areas of the track pertinent to play of the game. Specifically, there are starting point indicators 24 having a plurality of starting block squares 26 extending therefrom at a diagonal orientation across the lanes of the track 14, as is done on a conventionally known and full-scale track to compensate for the shorter distance of the inside track. Along the track, there are a plurality of sets of diagonally oriented performance card marker squares 28 which may be red in color and will operate to affect play of the game as described below. Blue hurdle markers 30 extend transversely across the lanes of the track 14 and serve to represent hurdles during play of the game 10. The track 14 is also divided into several zones including a pink fatigued zone 32, a yellow non-bias zone 34, and a green finish zone 36. The indicia 24–36 each serve a distinct purpose during play of the game 10 as set forth below.

Figure 5:
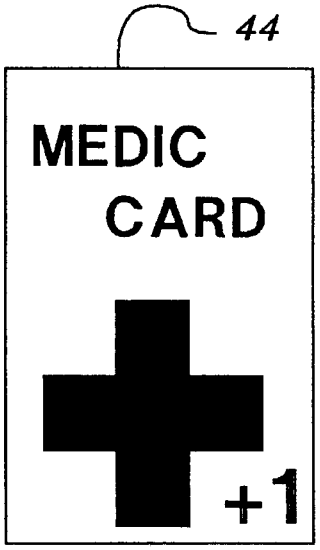
FIG. 5 is a plan view of a first type of card of the invention.
Figure 6:
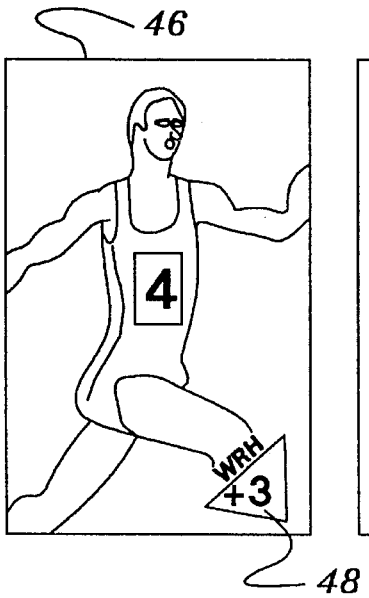
FIG. 6 is a plan view of a second type of card of the invention.
Figure 7:
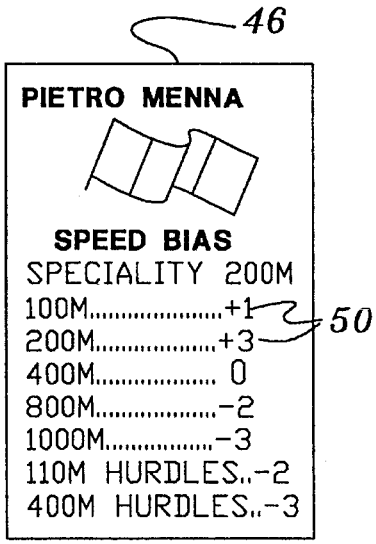
FIG. 7 is a plan view of a third type of card of the invention.

Apparatus of the invention 10 further includes, as shown in FIGS. 3 through 7, the dice 16, a player marker 40 having a peg 42 which can support the player marker relative to the game board 12 by resting thereon or piercing thereinto. FIGS. 5 through 7 show various types of the cards 18 to include performance cards 44 such as the one shown in FIG. 5, and speed bias cards 46, the front of which is shown in FIG. 6 and back of which is shown in FIG. 7. The speed bias cards 46 each feature a different known athlete on the front and have statistical information printed on the back which indicates the speed bias assigned to this particular athlete.

The speed bias cards 46 each feature a known track superstar. On the front of the card 46, there is the front speed bias number 48 is the advantage (+) or disadvantage (–) a runner has for all events (such as 400 m, 800 m, etc.). The rear speed bias numbers 50 represent the advantage (+) or disadvantage (–) a runner has for that event listed on the rear of the speed bias card 46.

The performance cards 44 dictate the flow and fate of a player. The performance marker squares 28 of the track 14 operate to direct a player to select a performance card 44 when the player marker 40 of that player lands on that square. The performance card 44 will have either a positive or negative performance number directing the player to move that player's player marker 40 in either the forward or reverse directions, respectively, that number of squares. The number on the performance card 44 may also have a multiplication symbol (X) marked thereon next to the performance number in which case the player will roll the dice and multiply the number of both dice by the performance number to advance or reverse the resulting number of squares. In addition, certain ones of the performance cards 44 can be provided with keeping indicia such as the letter "K" directing the player to keep that card for the rest of the event. Otherwise, all performance cards 44 are returned or discarded after a roll of the dice. Some of the performance cards 44 can state specifically that they affect either positively or negatively the effects of any of the other performance cards 44 which a player may have drawn or may draw. At least one of the performance cards 44 may operate only once a player's player marker 40 has been advanced past the fatigued zone 32 of the track 14.

METHOD OF THE GAME

The object of the game 10 is to simulate track competition. Players try to score the most points or accumulate the most medals to win the game 10. Players agree on what events will be run before commencing the game. The events and scores obtained from completion thereof can be recorded on the play sheet 22. The events can be designated as sprint events only (less than 800 m), distance events only (over 400 m), or sprint and distance events (100 m to 1500 m or over). Points can be awarded to the players of each event as follows: first place=50 points; second place=40 points; third place=30 points; fourth place=20 points; fifth place=10 points; and sixth place=5 points. Medals can be awarded to the players of each event as follows: first place=gold; second place=silver; and third place=bronze.

The game 10 can be played in three different ways: flat, fantasy, and real world. The "flat" way eliminates the speed bias cards 46 from the game and allows use of only the dice 16 and performance cards 44. The "fantasy" way of playing includes both the speed bias cards 46 and the performance cards 44 in conjunction with the dice 16. The "real world" way includes both the speed bias cards 46 and the performance cards 44 in conjunction with the dice 16, and also uses only the front speed bias number 48 from the front of the card, as shown in FIG. 6, as opposed to the rear speed bias numbers 50 printed on the rear of the speed bias cards 46. Further, the "real world" way requires separating the speed bias cards 46 to be grouped together into 100 m, 200 m, 400 m, etc. categories, according to the athletes specialty event listed on the rear of the card. Each player then can select a card from the group for the selected event, e.g. the event decided to be played before the game began. The player will then receive the front speed bias number 48 printed on the front of the card 46.

Of the six concentric lanes of the track 14, players can either choose or randomly select the lanes by rolling the dice 16. The lane choice determines the order of play of the game, where the player in the first lane goes first, the player in the second lane goes second, etc. The lanes can be consecutively numbered from either the inside or the outside track.

Each lane of the track 14, as shown in FIGS. 1 and 2, is divided into a plurality of squares. Thus, play of the game can be commenced by the first player rolling the dice and moving the player marker 40 a number of squares forward in a counter-clockwise direction around the appropriate lane of the track 14. If a player rolls double ones on the dice, e.g. each dice shows a one, at the start of the event, then the player is disqualified from that event. However, if a player rolls double ones on the dice during the event, then the player can move and then retain his turn to roll again.

Before the running of each event, players randomly select a speed bias card 46 for each player marker 40 which will control the movements of the particular player marker. Additional cards can be chosen to permit reserve athletes to be used for the events as desired. Further, the speed bias cards 46 can be traded between players as desired. The speed bias cards are applied to every roll of the dice, whereby the rear speed bias number 50 for the particular event is used to move the player marker 40 that number of spaces either in the forward direction (+) or in the reverse direction (–), except when the player marker is in the yellow non-bias zone 34. Further rules of the game may only allow the negative rear speed bias numbers 50 to apply in the last lap of an event.

As noted above, the performance card marker squares 28 operate to direct a player to select a performance card 44 when the player marker 40 of that player lands on that square. The positive or negative performance number of the performance card will then directing the player to move that player's player marker 40 in either the forward or reverse directions, respectively, that number of squares. If the number on the performance card 44 has a multiplication symbol (X) marked thereon, the player will roll the dice and multiply the number of both dice by the performance number to advance or reverse the resulting number of squares.

To increase a players chance of obtaining more medals or points, a number of qualifying heats can be run. Players may choose to run heats if they are using more than one game piece for an event to get to the finals. If two heats are run, for example, then the players who finish first, second, and third will advance to the final rounds. When playing heats, a single player may not have more than one game piece or marker 40 on the track 14.

When running a heat or final round, the laps of the events can be determined relative to the length of the run. For example, a 400 m event may be one lap around the track 14. Other events would be proportionately shorted or longer. When running, if a player lands on a blue hurdle marker 30, representing the physical striking of the hurdle in a real track event, then the player must miss the next turn.

The game can be played as a relay event where each player has two or more player markers 40. In this event, there can be a predetermined number of relay exchanging zone which can be designated as any desired portion of the track 14 such as the finishing zone 36, for example. In this form of the game, the players each place all player markers, with one player marker 40 for each player being positioned at the starting area and the other markers being positioned on a desired square within the relay exchanging zone (the finishing zone 36 in this example). The race is then run with the first player markers moving around the board until they approach the relay exchanging zone and the player lands in the relay exchanging zone in which case that player marker is removed and the other player marker is substituted and the race continued.

However, if the number registered on one die would land the player marker on a square in the relay exchange zone, but the number registered on the other die would go beyond the zone, then that player marker is removed and the other player marker is substituted and the other player marker moved backwards from the square in the relay exchanging zone in a clockwise direction. If both numbers of the die would each individually advance the player's player marker 40 beyond the relay exchanging zone, then the player will lose that turn and must wait for the next turn to roll a number on at least one die which advances that player marker 40 into the relay exchanging zone. If the placement of the player marker in the relay exchanging zone occurs on the exact square where the other player marker 40 of that player is positioned, then it is considered a perfect exchange and the other player marker of that player is advanced ten extra squares. If desired, the rules may allow the other player marker of that player to be positioned on any square within the relay exchanging zone at any time prior to the roll of the dice. Also, the rules may require disqualification of the player if double ones are rolled when attempting to land in the relay exchanging zone.

To finish either a regular race or heat and a relay event, the player must land within the finishing zone 36. A player may choose to advance to the finishing zone 36 by the number registered on either or both of the dice.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a simulated track competition game comprising:

providing a game board having an oval track printed thereon, the track being divided into a plurality of squares;

providing a pair of dice;

providing a plurality of player markers;

providing a plurality of speed bias cards, the speed bias cards each having a speed bias number printed on the speed bias card, the speed bias number being selected from the group consisting of positive and negative numbers;

selecting a first player;

rolling of the dice by the first player;

assigning at least one of the player markers to the first player as the first player marker;

randomly choosing a speed bias card for the first player marker;

moving the first player marker a number of squares forward in a predetermined forward direction around the track;

and, moving the first player marker an additional number of squares according to the speed bias number on the speed bias card in the forward direction if the speed bias number is positive and in a reverse direction opposite that of the forward direction if the speed bias number is negative.

2. The method of playing a simulated track competition game of claim 1, and further comprising the steps of:

providing a plurality of performance cards, the performance cards each having a performance number printed on the front, the performance number being selected from the group consisting of positive and negative numbers;

providing performance card marker squares printed on the track which operate to direct a player to randomly select a performance card when a player's player marker lands on one of the performance card marker squares;

randomly selecting a performance card by the first player if the first player's player marker lands on one of the performance card marker squares;

moving the first player marker an additional number of squares according to the performance number on the performance card in the forward direction if the performance number is positive and in a reverse direction opposite that of the forward direction if the speed bias number is negative.

3. The method of playing a simulated track competition game of claim 2, and further comprising the steps of:

providing at least one of the performance cards with a multiplication symbol (X) marked thereon;

requiring the first player to roll the dice if the performance card having the multiplication symbol (X) marked thereon is drawn by the first player;

moving the first player marker an additional number of squares according to the performance number multiplied by the sum of the numbers on the dice in the forward direction if the performance number is positive and in a reverse direction opposite that of the forward direction if the performance number is negative.

4. The method of playing a simulated track competition game of claim 3, and further comprising the steps of:

providing at least one of the performance cards with a keeping indicia printed thereon;

requiring the first player to retain the performance card with the keeping indicia printed thereon and use the performance card with the keeping indicia printed thereon for each turn of the game.

5. The method of playing a simulated track competition game of claim 4, and further comprising the steps of:

requiring the first player to use the speed bias card in every turn of the game.

6. The method of playing a simulated track competition game of claim 1, and further comprising the steps of:

providing a predetermined number of relay exchanging zones marked on the track;

placing at least one of the player markers designated as the relay player marker on a square within one of the relay exchanging zones marked on the track;

replacing first player marker with the relay marker when the first player marker lands in the relay exchanging zone.

7. The method of playing a simulated track competition game of claim 6, and further comprising the steps of:

requiring at least one of the numbers rolled on the dice to advance the first player marker into and not beyond the relay exchanging zone.

8. The method of playing a simulated track competition game of claim 7, and further comprising the steps of:

moving the relay player marker in the reverse direction from the square in the relay exchanging zone, if the number registered on one of the dice would advance the first player marker beyond the relay exchange zone.

9. The method of playing a simulated track competition game of claim 8, and further comprising the steps of:

moving the relay player marker a predetermined number of squares in the forward direction from the square in the relay exchanging zone, if the number registered on one of the dice would advance the first player marker onto the square which the relay player marker is positioned.

* * * * *